US012104441B2

(12) United States Patent
Keane et al.

(10) Patent No.: US 12,104,441 B2
(45) Date of Patent: Oct. 1, 2024

(54) SYSTEM AND METHOD FOR CONNECTING MULTIPLE STAGE COMPLETIONS

(71) Applicant: Schlumberger Technology Corporation, Sugar Land, TX (US)

(72) Inventors: Raymond Keane, Houston, TX (US); Gabriel Isaicu, Missouri City, TX (US); Michael Elkomos, Spring, TX (US); Marcelo Oblitas Ruiz, Baku (AZ); Carlos Emilio Webel, Baku (AZ); Saeed Molavi, Baku (AZ); Ernani Jeronimo, Rio de Janeiro (BR)

(73) Assignee: Schlumberger Technology Corporation, Sugar Land, TX (US)

( * ) Notice: Subject to any disclaimer, the term of this patent is extended or adjusted under 35 U.S.C. 154(b) by 38 days.

(21) Appl. No.: 18/000,472

(22) PCT Filed: Jun. 2, 2021

(86) PCT No.: PCT/US2021/035478
§ 371 (c)(1),
(2) Date: Dec. 1, 2022

(87) PCT Pub. No.: WO2021/247726
PCT Pub. Date: Dec. 9, 2021

(65) Prior Publication Data

US 2023/0212915 A1 Jul. 6, 2023

Related U.S. Application Data

(60) Provisional application No. 62/704,939, filed on Jun. 3, 2020.

(51) Int. Cl.
*E21B 17/05* (2006.01)
*E21B 17/02* (2006.01)
*E21B 47/135* (2012.01)

(52) U.S. Cl.
CPC ..... *E21B 17/05* (2013.01); *E21B 17/028* (2013.01); *E21B 47/135* (2020.05)

(58) Field of Classification Search
CPC ..... E21B 17/028; E21B 17/05; E21B 47/135
See application file for complete search history.

(56) References Cited

U.S. PATENT DOCUMENTS 4,039,208 A 8/1977 Pernet
4,570,707 A 2/1986 Setterberg, Jr.
(Continued)

FOREIGN PATENT DOCUMENTS

EP 1212510 A1 6/2002
EP 1251598 A1 10/2002
(Continued)

OTHER PUBLICATIONS

International Search Report and Written Opinion issued in the PCT Application PCT/US2021/035478, dated Nov. 12, 2021 (12 pages).
(Continued)

*Primary Examiner* — Caroline N Butcher
(74) *Attorney, Agent, or Firm* — Jeffrey D. Frantz

(57) ABSTRACT

Systems and methods are provided to facilitate connection of multiple stage completions. A first completion stage is deployed at a wellbore location. Subsequently, the next completion stage is moved downhole into engagement with the first completion stage. The completion stages each have communication lines that are coupled together downhole via movement of the completion stages into engagement.

19 Claims, 12 Drawing Sheets

(56) References Cited

U.S. PATENT DOCUMENTS

| | | | |
|---|---|---|---|
| 4,682,848 | A | 7/1987 | Cairns |
| 5,197,546 | A | 3/1993 | Murray |
| 5,577,925 | A | 11/1996 | Schnatzmeyer |
| 5,838,857 | A | 11/1998 | Niekrasz |
| 6,131,663 | A | 10/2000 | Henley |
| 6,152,608 | A | 11/2000 | Ghara |
| 6,186,229 | B1 | 2/2001 | Martin |
| 6,349,767 | B2 | 2/2002 | Gissler |
| 6,390,193 | B1 | 5/2002 | Martin |
| 6,510,899 | B1 | 1/2003 | Sheiretov et al. |
| 6,511,335 | B1 | 1/2003 | Rayssiguier |
| 6,568,481 | B2 | 5/2003 | Koehler |
| 6,571,046 | B1 | 5/2003 | Hickey |
| 6,668,921 | B2 | 12/2003 | Koehler |
| 6,776,636 | B1 | 8/2004 | Cameron |
| 6,929,404 | B2 | 8/2005 | Jones |
| 6,983,796 | B2 | 1/2006 | Bayne |
| 7,165,892 | B2 | 1/2007 | Grigsby |
| 7,191,832 | B2 | 3/2007 | Grigsby |
| 7,228,898 | B2 | 6/2007 | Grigsby |
| 7,252,437 | B2 | 8/2007 | Ringgenberg |
| 7,398,822 | B2 | 7/2008 | Meijer |
| 7,475,734 | B2 | 1/2009 | Edward |
| 7,487,830 | B2 | 2/2009 | Wolters |
| 7,503,395 | B2 | 3/2009 | Meijer et al. |
| 7,509,000 | B2 | 3/2009 | Coronado |
| 7,510,003 | B2 | 3/2009 | Meijer |
| 7,556,093 | B2 | 7/2009 | Grigsby |
| 7,594,763 | B2 | 9/2009 | Richards |
| 7,607,477 | B2 | 10/2009 | Stoesz |
| 7,611,290 | B2 | 11/2009 | Ringgenberg |
| 7,628,543 | B2 | 12/2009 | Coronado |
| 7,640,977 | B2 | 1/2010 | Jonas |
| 7,644,755 | B2 | 1/2010 | Stoesz |
| 7,736,067 | B2 | 6/2010 | Read |
| 7,798,212 | B2 | 9/2010 | Bolze et al. |
| 7,806,190 | B2 | 10/2010 | Du |
| 7,900,698 | B2 | 3/2011 | Stoesz |
| 8,061,429 | B2 | 11/2011 | Du |
| 8,061,430 | B2 | 11/2011 | Du |
| 8,082,990 | B2 | 12/2011 | Lovell |
| 8,113,290 | B2 | 2/2012 | Sharma |
| 8,496,064 | B2 | 7/2013 | Du |
| 8,550,175 | B2 | 10/2013 | Shafiq |
| 8,596,348 | B2 | 12/2013 | Brookbank |
| 8,752,635 | B2 | 6/2014 | Wang |
| 8,794,337 | B2 | 8/2014 | Thomas |
| 8,839,850 | B2 | 9/2014 | Algeroy |
| 8,936,078 | B2 | 1/2015 | Richards |
| 9,157,561 | B2 | 10/2015 | Martin |
| 9,270,051 | B1 | 2/2016 | Christiansen |
| 9,404,314 | B2 | 8/2016 | Perez |
| 9,523,243 | B2 | 12/2016 | Richards |
| 9,627,798 | B2 | 4/2017 | Plant |
| 9,683,412 | B2 | 6/2017 | Richards |
| 9,759,016 | B2 | 9/2017 | Perez |
| 9,850,720 | B2 | 12/2017 | Richards |
| 9,915,104 | B2 | 3/2018 | Richards |
| 9,945,203 | B2 | 4/2018 | Patel |
| 9,988,894 | B1 | 6/2018 | Malone |
| 10,000,995 | B2 | 6/2018 | Bishop |
| 10,060,196 | B2 | 8/2018 | Richards |
| 10,113,371 | B2 | 10/2018 | Richards |
| 10,267,097 | B2 | 4/2019 | Mendez |
| 10,329,855 | B2 | 6/2019 | Brady |
| 10,329,871 | B2 | 6/2019 | King |
| 10,352,110 | B2 | 7/2019 | Olin |
| 10,502,003 | B2 | 12/2019 | Johnson |
| 10,619,424 | B2 | 4/2020 | Loh |
| 10,934,785 | B2 | 3/2021 | Fripp |
| 11,162,306 | B2 | 11/2021 | Simonsen |
| 11,193,339 | B2 | 12/2021 | El Mallawany |
| 11,646,526 | B2 | 5/2023 | Burrow |
| 2003/0211768 | A1 | 11/2003 | Cameron |
| 2005/0072564 | A1 | 4/2005 | Grigsby |
| 2006/0086508 | A1 | 4/2006 | Coon |
| 2006/0243450 | A1 | 11/2006 | Head |
| 2006/0243454 | A1 | 11/2006 | Bolze et al. |
| 2006/0260803 | A1 | 11/2006 | Meijer et al. |
| 2008/0029274 | A1 | 2/2008 | Rytlewski |
| 2008/0223585 | A1 | 9/2008 | Patel |
| 2009/0045146 | A1 | 2/2009 | Stoesz |
| 2009/0321069 | A1* | 12/2009 | Jonas ..... E21B 17/046 166/242.6 |
| 2010/0314109 | A1 | 12/2010 | Garcia et al. |
| 2011/0192596 | A1 | 8/2011 | Patel |
| 2013/0048307 | A1 | 2/2013 | Patel |
| 2013/0306316 | A1 | 11/2013 | Patel |
| 2013/0319685 | A1 | 12/2013 | Pike |
| 2013/0327546 | A1 | 12/2013 | Rytlewski |
| 2014/0352793 | A1 | 12/2014 | Martin et al. |
| 2015/0368983 | A1 | 12/2015 | Perez et al. |
| 2016/0006161 | A1 | 1/2016 | Ranalli |
| 2016/0273290 | A1 | 9/2016 | Harms |
| 2016/0356095 | A1 | 12/2016 | Perez |
| 2017/0044843 | A1 | 2/2017 | Hanton |
| 2017/0357051 | A1 | 12/2017 | Bulu |
| 2020/0080398 | A1 | 3/2020 | Loh |
| 2021/0032940 | A1* | 2/2021 | Simonsen ..... E21B 17/028 |

FOREIGN PATENT DOCUMENTS

| | | | |
|---|---|---|---|
| GC | 2881 | A | 9/2014 |
| WO | 2004079151 | A2 | 9/2004 |
| WO | 2014089132 | A1 | 6/2014 |
| WO | 2015060817 | A1 | 4/2015 |
| WO | 2015044208 | A3 | 6/2015 |
| WO | 2017105434 | A1 | 6/2017 |
| WO | 2017213726 | A2 | 12/2017 |
| WO | 2020087001 | A1 | 4/2020 |
| WO | 2022109157 | A1 | 5/2022 |
| WO | 2022192669 | A1 | 9/2022 |
| WO | 2022216933 | A1 | 10/2022 |

OTHER PUBLICATIONS

International Search Report and Written Opinion of International Patent Application No. PCT/US2021/059923 dated Mar. 11, 2022, 11 pages.

"Control Line Wet Mate (CLWM) Connector", product sheet downloaded from [https://www.slb.com/-/media/files/co/product-sheet/control-line-wet-mate-ps.ashx] on Jun. 29, 2022, 2 pages.

"HLWM Hydraulic-line downhole wet-mate connector", product sheet downloaded from [https://www.slb.com/-/media/files/co/product-sheet/hlwm-ps.ashx] downloaded on Jun. 29, 2022, 2 pages.

"HEWM Hydraulic and electric downhole wet-mate connector" product sheet downloaded from [https://www.slb.com/-/media/files/co/product-sheet/hewm-ps.ashx] downloaded on Jun. 29, 2022, 2 pages.

B.K. Drakeley et al., 2014, "Integration into the Sandface Tool System for Gravel and Frack-Pack Installations with a Fiber Optics Wet-Mate Connector System", OTC-25195-MS, Offshore Technology Conference, held in Houston, Texas, USA, May 5-8, 2014 (15 pages).

International Search Report and Written Opinion of International Patent Application No. PCT/US2022/019952 dated Jun. 20, 2022, 10 pages.

International Search Report and Written Opinion of International Patent Application No. PCT/US2022/023838 dated Jul. 26, 2022, 12 pages.

"SureCONNECT Downhole Intelligent Wet-Mate System", downloaded on May 21, 2023 from link https://www.bakerhughes.com/completions/well-monitoring-and-analytics/sureconnect-downhole-intelligent-wetmate-system (8 pages).

"QUANTUM Snap Latch Assembly", (2014) SLB product sheet, downloaded on May 21, 2023, from link https://www.bing.com/searchq=QUANTUM+Snap+Latch+Assembly search= pc=U522 form=CHRDEF, (1 page).

"QUANTUM Anchor Latch Assembly", (2014) SLB product sheet, downloaded on May 21, 2023 from link https://www.bing.com/

(56) References Cited

OTHER PUBLICATIONS searchq=QUANTUM+Anchor+Latch+Assembly qs=n form=QBRE sp=-1 ghc=1 lq=0 pq=quantum+anchor+latch+assembly sc=6-29 sk= cvid=C6BC1C74AC8C44EC9D227795D68F1DD9 ghsh=0 ghacc-0 ghpl= (1 page).

"QUANTUM Shear-Type Anchor Latch" (2014), SLB product sheet, downloaded on May 21, 2023, from link https://www.bing.com/searchq=QUANTUM+Shear-Type+Anchor+Latch qs=n form=QBRE sp=-1 ghc=1 lq=0 pq=quantum+shear-type+anchor+latch sc=6-31 sk= cvid=A2F41C06C6DB44198EEFF506C1CB5DFB ghsh=0 ghacc=0 ghpl= (1 page).

* cited by examiner

SYSTEM AND METHOD FOR CONNECTING MULTIPLE STAGE COMPLETIONS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a National Stage of International Application No. PCT/US2021/035478, filed Jun. 2, 2021, which claims priority benefit of U.S. Provisional Application No. 62/704,939, filed Jun. 3, 2020, the entirety of each of which is incorporated by reference herein and should be considered part of this specification.

BACKGROUND

Field

The present disclosure generally relates to multi-stage completions, and more particularly to systems and methods for connecting multi-stage completions.

Description of the Related Art

Many types of wells, e.g., oil and gas wells, are completed in multiple stages. For example, a lower stage of the completion, or lower completion assembly, is moved downhole on a running string. After deployment of the lower completion assembly at a desired location in the wellbore, an upper stage of the completion, or upper completion assembly, is deployed downhole and engaged with the lower completion assembly.

In many applications, it is desirable to instrument the lower completion with electrical or optical sensors or to provide for transmission of fluids to devices in the lower completion. For example, a fiber optic cable can be placed in the annulus between the screen and the open or cased hole. To enable communication of signals between the sensor in the lower completion and the surface or seabed, a wet-mate connection is needed between the upper and lower completion equipment.

SUMMARY

In some configurations, a downhole completion system includes a lower completion stage having a receptacle and a first communication line connector; an upper completion stage having a stinger and a second communication line connector; and an alignment feature configured to align the first communication line connector with the second communication line connector upon sufficient insertion of the stinger into the receptacle to enable coupling of the first and second communication line connectors; wherein, when deployed in a wellbore, the receptacle is configured to be positioned below or downhole of a packer, and the stinger is configured to extend through the packer, such that the coupling of the first and second communication line connectors is positioned below or downhole of the packer, and when the stinger is received in the receptacle, a portion of the stinger is positioned above or uphole of the packer and a portion of the stinger is positioned below or downhole of the packer.

Fiber optic lines can be coupled to the first and second communication line connectors. Tubing lines can be coupled to the first and second communication line connectors. The tubing lines can be sized to receive a fiber optic line therethrough. The first and second communication line connectors can be or include electrical connectors, and the coupling of the first and second communication line connectors can be an electrical connection below the packer.

A portion of the stinger can be configured to rotate relative to a remainder of the upper completion during deployment. During insertion of the stinger into the receptacle, rotation of the portion of the stinger can occur at least partially above or uphole of the packer.

In some configurations, a method of forming a completion in a wellbore includes deploying a lower completion stage in a wellbore downhole of a packer, the lower completion stage comprising a receptacle and a first communication line connector; deploying an upper completion stage in the wellbore, the upper completion stage comprising a stinger and a second communication line connector, wherein deploying the upper completion stage in the wellbore comprises extending a portion of the stinger through the packer; inserting the stinger in the receptacle; and coupling the first and second communication line connectors.

The lower completion stage can include a lower fiber coupled to the first communication line connector, and the upper completion stage can include an upper fiber coupled to the second communication line connector. The first and second communication line connectors can be or include electrical connectors. In some configurations, the lower completion stage includes a lower tubing line coupled to the first communication line connector, and the upper completion stage comprises an upper tubing line coupled to the second communication line connector. The method can include pumping a fiber optic line through the upper tubing line, through the coupled first and second communication line connectors, and through the lower tubing line.

In some configurations, a stage of a downhole completion system includes a swivel sub; a shaft coupled to and extending from the swivel sub in a first direction; an inner tube disposed partially within the swivel sub and extending from the swivel sub in a second direction opposite the first direction; and at least one anti-rotation feature configured to rotationally lock the swivel sub relative to the inner tube in a locked position and configured to allow rotational movement of the swivel sub relative to the inner tube in an unlocked position.

The stage can include two anti-rotation features. The two anti-rotation features can be disposed 180° degrees apart from each other about a circumference of the swivel sub. The two anti-rotation features can be axially offset from each other along the swivel sub. The anti-rotation feature can include an anti-rotation pin and a lever, wherein the anti-rotation pin is coupled to the swivel sub and configured to engage the inner tube in the locked position, and wherein the lever is configured to lift the anti-rotation pin out of engagement with the inner tube in the unlocked position. The stage can further include a sleeve configured to move the anti-rotation feature from the locked position to the unlocked position. The sleeve can be coupled to a downhole packer. A method of deploying such a stage can include moving the stage through the packer such that the sleeve contacts the anti-rotation feature and moves the anti-rotation feature to the unlocked position.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
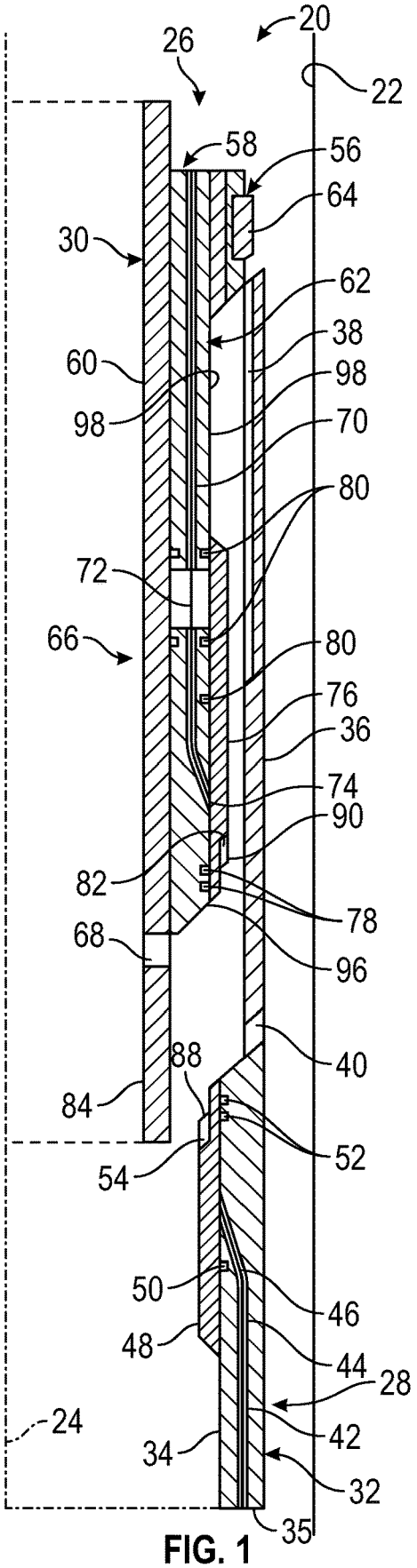
FIG. 1 is a schematic view of a wellbore with a multiple stage completion having completion stages being moved into engagement, according to an embodiment of the present invention.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Many types of wells, e.g., oil and gas wells, are completed in multiple stages. For example, a lower stage of the completion, or lower completion assembly, is moved downhole on a running string. After deployment of the lower completion assembly at a desired location in the wellbore, an upper stage of the completion, or upper completion assembly, is deployed downhole and engaged with the lower completion assembly.

Many well completions incorporate one or more control lines, such as optical, electrical, or fluid control lines, to carry signals to or from components of the downhole completion. For example, in many applications, it is desirable to instrument the lower completion with electrical or optical sensors or to provide for transmission of fluids to devices in the lower completion. To enable communication of signals between the sensor in the lower completion and the surface or seabed, a wet-mate connection is needed between the upper and lower completion equipment. The completion of wells in two or more stages, however, can create difficulties in forming dependable and repeatable control line connections between adjacent completion assemblies.

Optical, electrical, and fluid wet-mate connectors typically are designed as discrete stand-alone components. The stand-alone connectors are mated in a downhole environment that can be full of debris and contaminants. For instance, the mating can take place after an open hole gravel pack which creates a high probability for substantial amounts of debris and contaminants in the wellbore at the vicinity of the connectors during the mating sequence. Existing discrete optical, electrical and fluid wet-mate connectors have proven to be very susceptible to contamination by debris during the mating process.

Furthermore, the discrete nature of the connectors results in an unfavorable geometry that can be difficult to integrate into the completion equipment. The outer diameter of the completion equipment must fit within the inner casing diameter. A centralized, large diameter inner port also is needed to provide access for service equipment into the lower completion and to provide a large flow area for production or injection of fluids. The remaining annular space is not well suited to the typical circular cross section of discrete connectors. This limitation compromises the overall design of the completion equipment and also limits the total number of channels that can be accommodated within a given envelope.

The geometry of the discrete connectors also increases the difficulty of adequate flushing and debris removal from within and around the connectors prior to and during the mating sequence. Attempts to protect the connectors from debris and/or to provide adequate flushing have lead to completion equipment designs that have great complexity with an undesirable number of failure modes.

The present disclosure provides systems and methods for connecting an upper completion with a lower completion. As used herein, "lower" can refer to a first or lead equipment/assembly moved downhole. "Upper" can refer to a second or later equipment/assembly moved downhole into engagement with the lower unit. In a horizontal wellbore, for example, the lower equipment/assembly is run downhole first prior to the upper equipment/assembly. Such systems and methods allow for various types of connections and/or communication between the upper and lower completion, for example, control line communication and/or connection, fiber optic communication and/or connection, electrical connection and/or communication, etc.

Systems and methods according to the present disclosure can advantageously allow for monitoring, e.g. continuous real time monitoring, or temperature (or other data) along the entire length of the upper and lower completion, for example, using an optical fiber deployed or housed within a control line. Additionally or alternatively, systems and methods according to the present disclosure can advantageously allow for water injection and/or hydraulic communication to or with the lower completion. In some configurations, systems and methods according to the present disclosure advantageously allow for transmission of signals, e.g., electrical and/or hydraulic signals, to actuate various devices along the lower completion 28 string, such as flow control devices and/or flow isolation valves. Additionally or alternatively, such signals, e.g., electrical and/or hydraulic signals, can be used to actuate setting sequence(s) for packer(s).

In some configurations, systems and methods according to the present disclosure allow for deploying and connecting a fiber optic sensor network in a two-stage completion. In some configurations, the present disclosure provides systems and methods for coupling control lines, such as hydraulic lines, of the upper and lower completions. Fiber can then be pumped from the surface, for example, with water or another fluid, through the entire length of the coupled control lines to reach the lower completion. In other configurations, an optical fiber can be pre-deployed. The lower completion 28 can be run with fiber, then the upper completion 30 can be run with fiber, and the fiber of the upper completion 30 and fiber of the lower completion 28 can be mated via a connector. This can advantageously save time during deployment and installation as the fiber does not need to be pumped from the surface once a wetmate connection has been established. Once the connection is established, a continuous optical path is established from a surface location to the bottom of an open hole formation and back to the surface location to complete an optical loop.

The connection may also or alternatively be established for other control lines, such as electrical control lines or fluid control lines in various combinations. The connections may be established, broken and reestablished repeatedly. In some configurations, systems and methods according to the present disclosure provide an electrical connection and electrical communication between the upper and lower completions.

Connection systems and methods according to the present disclosure may be used for land applications, offshore platform applications, or subsea deployments in a variety of environments and with a variety of downhole components. The systems and methods can be used to connect a variety of downhole control lines, including communication lines, power lines, electrical lines, fiber optic lines, hydraulic conduits, fluid communication lines, and other control lines. The connections can allow for the deployment of sensors, e.g., fiber optic sensors, in sand control components, perforating components, formation fracturing components, flow control components, or other components used in various well operations including well drilling operations, completion operations, maintenance operations, and/or production operations.

The upper and lower completion assemblies can include a variety of components and assemblies for multistage well operations, including completion assemblies, drilling assemblies, well testing assemblies, well intervention assemblies, production assemblies, and other assemblies used in various well operations. The upper and lower assemblies can include a variety of components depending on the application, including tubing, casing, liner hangers, formation isolation valves, safety valves, other well flow/control valves, perforating and other formation fracturing tools, well sealing elements, e.g., packers, polish bore receptacles, sand control components, e.g., sand screens and gravel packing tools, artificial lift mechanisms, e.g., electric submersible pumps or other pumps/gas lift valves and related accessories, drilling tools, bottom hole assemblies, diverter tools, running tools and other downhole components. In some configurations, the systems and methods may be used to connect fiber-optic lines, electric lines, and/or fluid communication lines below an electric submersible pump to control flow control valves or other devices while allowing the electric submersible pump to be removed from the wellbore and replaced.

Referring generally to FIG. 1, a portion of a wellbore 20 is illustrated between a wellbore wall 22 and a wellbore centerline 24. A completion 26 is illustrated in cross-sectional profile as having a first or lower completion stage 28 and a second or upper completion stage 30. The lower completion stage generally is the stage deployed first into either a vertical or deviated wellbore. Also, the lower completion stage 28 and the upper completion stage 30 may comprise a variety of completion types depending on the specific wellbore application for which the multiple stage completion is designed. For example, the lower stage completion may be designed with sand screens or screens with gravel pack components. In FIG. 1, the lower completion stage 28 has been moved to a desired downhole location with a service tool or with other deployment or running equipment, as known to those of ordinary skill in the art. Once lower completion stage 28 is positioned in the wellbore and the deployment equipment is retrieved, the next completion stage 30 can be moved downhole toward engagement with the lower completion stage, as illustrated, to ultimately form a connection.

The lower completion stage 28 comprises a housing 32 that forms a receptacle 34 which is run into the wellbore and remains in the wellbore with lower completion stage 28 when the service tool is removed. Housing 32 comprises a lower body section 35 and a shroud 36, e.g. a helical shroud or muleshoe, having an alignment slot 38 and a flush port 40. Lower completion stage 28 also comprises a passageway 42 through housing 32 for routing of a communication line 44 to a communication line connector 46 integrated with the lower completion stage. Communication line 44 may comprise, for example, a fiber optic line, an electric line, an auxiliary conduit, or control line for transmitting hydraulic or other fluids, or a tubing for receiving a fiber optic line. Correspondingly, communication line connector 46 may comprise a fiber optic connector, an electric line connector, a hydraulic connector, or a tubing connector through which a fiber optic line is deployed. By way of specific example, communication line connector 46 comprises a fiber optic ferrule receptacle; communication line 44 comprises an optical fiber disposed within a flexible protected tube; and passageway 42 comprises an optical fluid chamber. The optical fluid chamber can be compensated to equal or near hydrostatic pressure in the wellbore, or the chamber can be at atmospheric pressure or another pressure.

In the illustrated embodiment, the lower completion stage 28 further comprises a displaceable member 48 movably disposed along a surface of receptacle 34 to enclose communication line connector 46. Enclosing communication line connector 46 protects the connector from wellbore debris and other contaminants prior to completing engagement of upper completion stage 30 with the lower completion stage. In the embodiment illustrated, displaceable member 48 is a sleeve, such as a spring loaded sleeve biased toward a position enclosing communication line connector 46. Displaceable member, e.g. sleeve, 48 may be sealed to housing 32 via at least one lower seal 50 and at least one upper seal 52. As illustrated, sleeve 48 also may comprise one or more debris exclusion slots 54.

The upper completion stage 30 comprises an upper completion housing 56 that forms a stinger 58 designed for insertion into and engagement with receptacle 34. Housing 56 may comprise an inner tubing 60, a surrounding upper body portion 62, and an alignment key 64. The inner tubing 60 has any interior 66 for conducting fluid flow and one or more radial flush ports 68 through which a flushing fluid can be conducted from interior 66 to the exterior of stinger 58. The surrounding upper body portion 62 may comprise a passageway 70 for routing of a communication line 72 to a communication line connector 74 integrated with the upper completion stage. As with lower completion stage 28, the communication line may comprise, for example, a fiber optic line, an electric line, an auxiliary conduit or control line for transmitting hydraulic or other fluids, or a tubing for receiving a fiber optic line. Correspondingly, communication line connector 74 may comprise a fiber optic connector, an electric line connector, a hydraulic connector, or a tubing connector through which a fiber optic line is deployed. By way of specific example, communication line connector 74 comprises a fiber optic ferrule plug or receptacle; communication line 72 comprises an optical fiber disposed within a flexible, protected tube that is extensible; and passageway 70 comprises an optical fluid chamber. The optical fluid chamber can be compensated to equal or near hydrostatic pressure in the wellbore, or the chamber can be at atmospheric pressure or another pressure.

The upper completion stage 30 further comprises an upper completion displaceable member 76 movably disposed along an outer surface of housing 56 to enclose communication line connector 74. Enclosing communication line connector 74 protects the connector from wellbore debris and other contaminants prior to completing engagement of upper completion stage 30 with the lower completion stage 28. Similar to displaceable member 48, upper completion displaceable member 76 may be formed as a movable sleeve, such as a spring loaded sleeve biased toward a position enclosing communication line connector 74. Displaceable member, e.g. sleeve, 76 may be sealed to housing 56 via at least one lower seal 78 and at least one upper seal 80. As illustrated, sleeve 76 also may comprise one or more debris exclusion slots 82.

Figure 2:
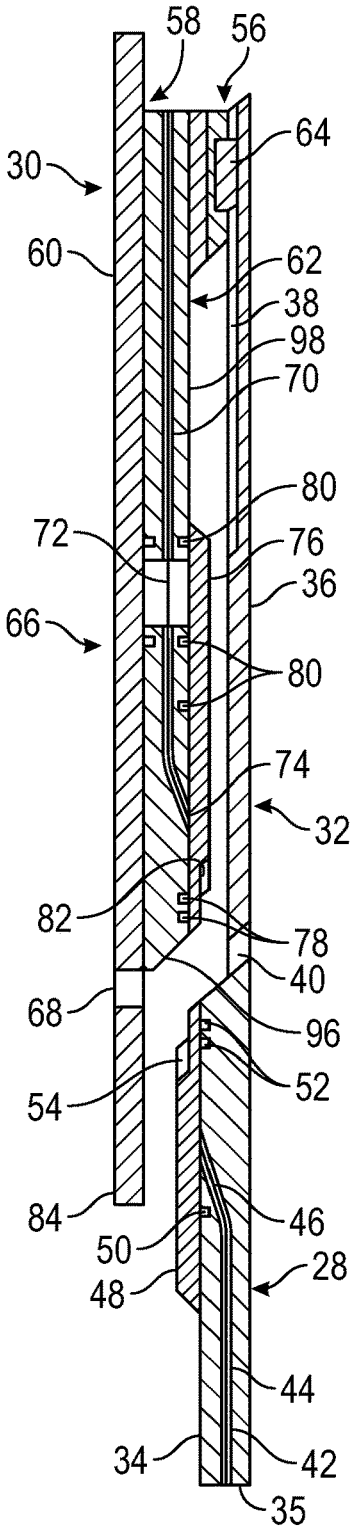
FIG. 2 is a schematic view similar to that of FIG. 1 but showing the first and second completion stages during a different period of the engagement process, according to an embodiment of the present invention.

As stinger 58 is moved into receptacle 34, alignment key 64 engages alignment slot 38, as illustrated best in FIG. 2. As the stinger continues to move into receptacle 34, alignment key 64 and alignment slot 38 cooperate to orient the upper completion stage 30 with respect to the lower completion stage 28 such that the lower communication line connector 46 and upper communication line connector 74 are properly aligned when the upper and lower completion stages are fully landed, i.e. engaged.

Figure 3:
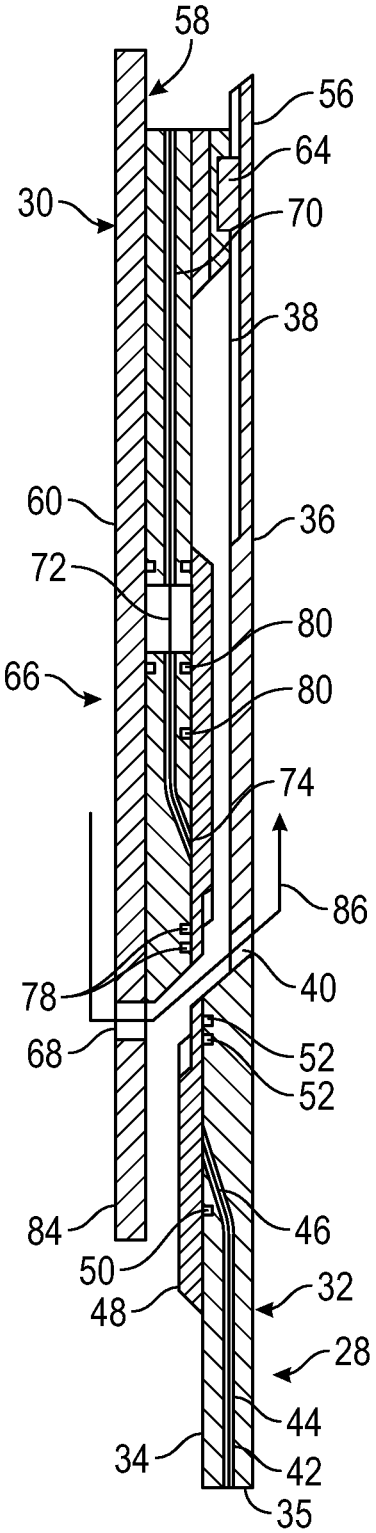
FIG. 3 is a schematic view similar to that of FIG. 1 but showing the first and second completion stages during another period of the engagement process, according to an embodiment of the present invention.

While the upper completion stage 30 is lowered into the wellbore and into engagement with lower completion stage 28, a flushing fluid is circulated continuously from the interior 66 of tubing 60 through a bottom opening 84 of tubing 60 and through radial flush ports 68. From radial flush ports 68, the fluid can circulate outwardly through flush ports 40 of lower completion stage 28 along a flushing flow path 86, as best illustrated in FIG. 3. The fluid velocity and flushing effectiveness increases as the gap narrows between upper completion stage 30 and lower completion stage 28. The completion may be designed such that seals on the upper completion stage 30 engage the lower completion stage 28 in a manner that blocks further flow through bottom opening 84. This forces all of the flushing fluid flow through radial flush ports 68 and 40 to further increase the flushing effectiveness in the vicinity of communication line connectors 46 and 74. In some configurations, the lower completion 28 does not include radial flush ports or other such openings, and the flushing fluid instead circulates back through an annular region between the stinger 58 and the receptacle 34. In some configurations, the flushing fluid also circulates through the control line(s).

Figure 4:
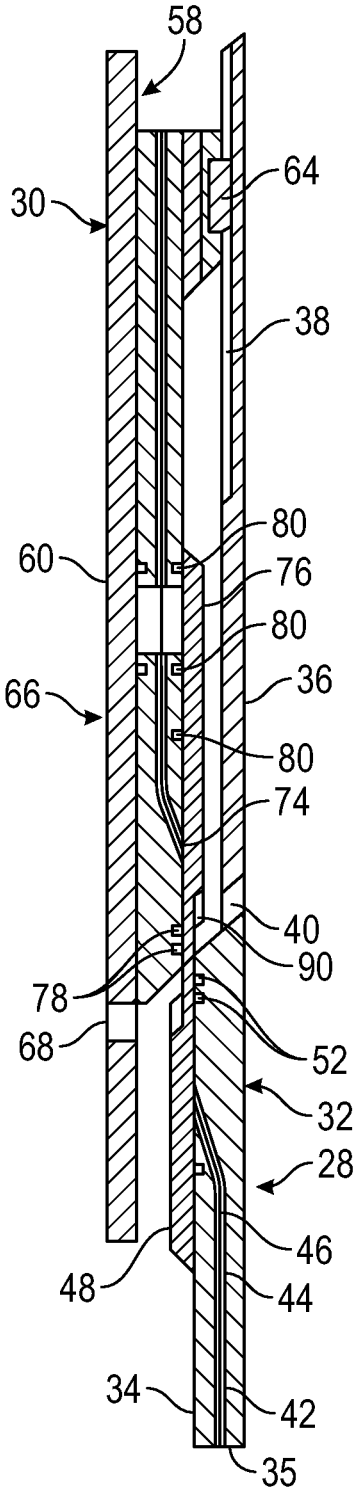
FIG. 4 is a schematic view similar to that of FIG. 1 but showing the first and second completion stages during another period of the engagement process, according to an embodiment of the present invention.
Figure 5:
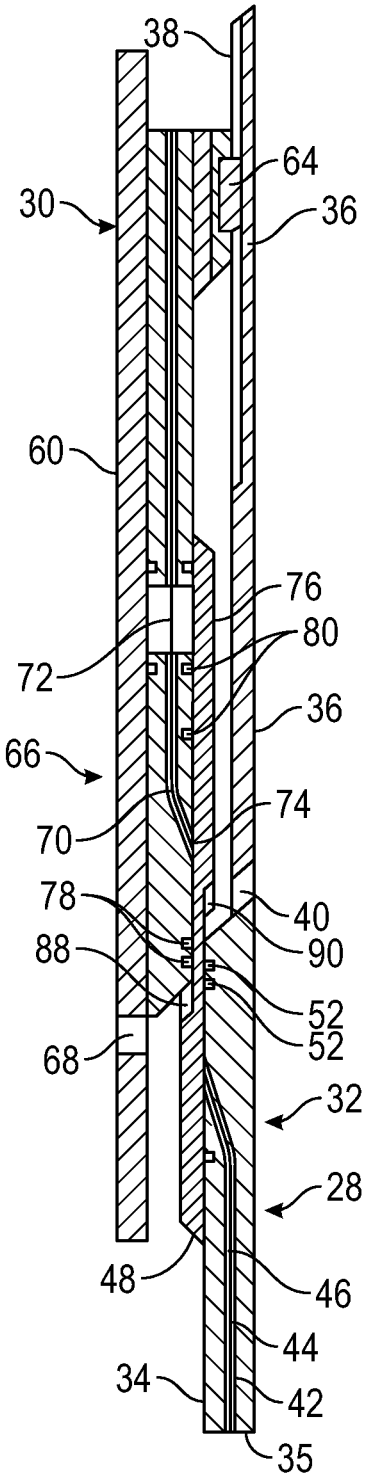
FIG. 5 is a schematic view similar to that of FIG. 1 but showing the first and second completion stages during another period of the engagement process, according to an embodiment of the present invention.

As the upper completion stage 30 is continually lowered, the upper sleeve 76 contacts the lower sleeve 48, as illustrated best in FIG. 4. The contact between sleeve 76 and sleeve 48 blocks further flow of flushing fluid from port 68 to port 40. The upper completion stage 30 is then allowed to move further into lower completion stage 28. This movement causes the upper sleeve 76 to retract and seals 78 to engage and move along the lower sleeve 48 until the upper body portion 62 reaches a mechanical stop 88, as illustrated best in FIG. 5.

Figure 6:
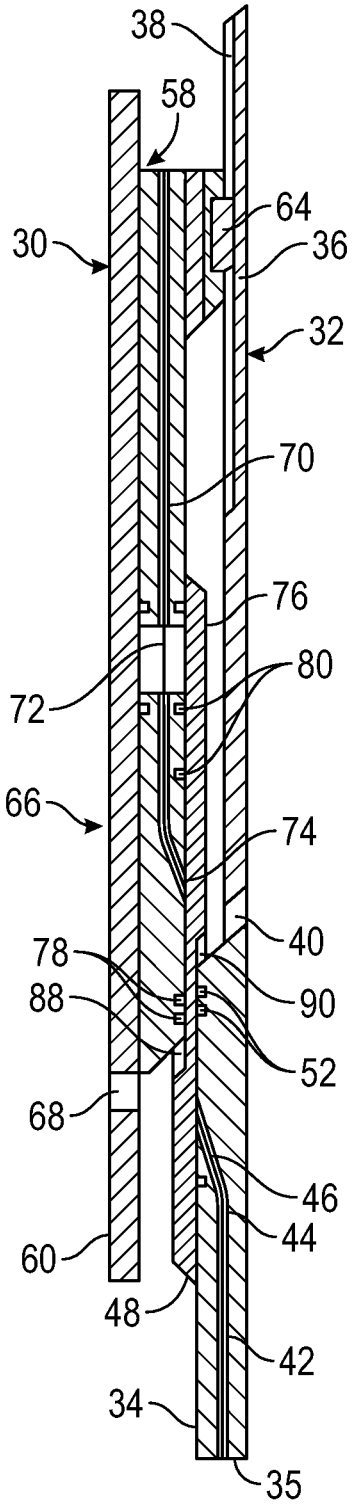
FIG. 6 is a schematic view similar to that of FIG. 1 but showing the first and second completion stages during another period of the engagement process, according to an embodiment of the present invention.

Further movement of the upper completion stage 30 causes the lower sleeve 48 to retract, as illustrated best in FIG. 6. It should be noted that in the embodiment illustrated, displaceable members 48 and 76 are being described as spring biased sleeves that are biased in a direction toward enclosing the communication line connector ends in a sealed environment. The retraction of lower sleeve 48 enables the upper sleeve 76 to continually move downward, creating a seal against lower body 35 in receptacle 34, until a mechanical stop 90 is reached. At this point, the upper completion stage 30 has become sealingly engaged with the lower completion stage 28.

The mechanical stops 88 and 90 determine the relative locations between upper body portion 62 and lower sleeve 48 and between upper sleeve 76 and lower body portion 35. Those relative locations remain fixed throughout the remainder of the landing/engagement sequence. Relative spring rates on spring biased sleeves 48, 76 can be used to control the opening sequence by determining which of the two sleeves retracts first.

Figure 7:
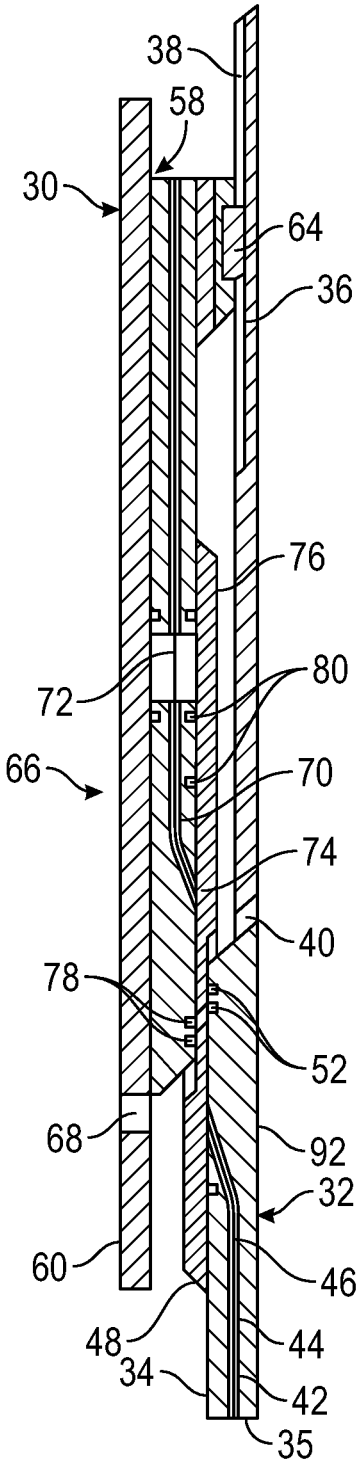
FIG. 7 is a schematic view similar to that of FIG. 1 but showing the first and second completion stages during another period of the engagement process, according to an embodiment of the present invention.
Figure 8:
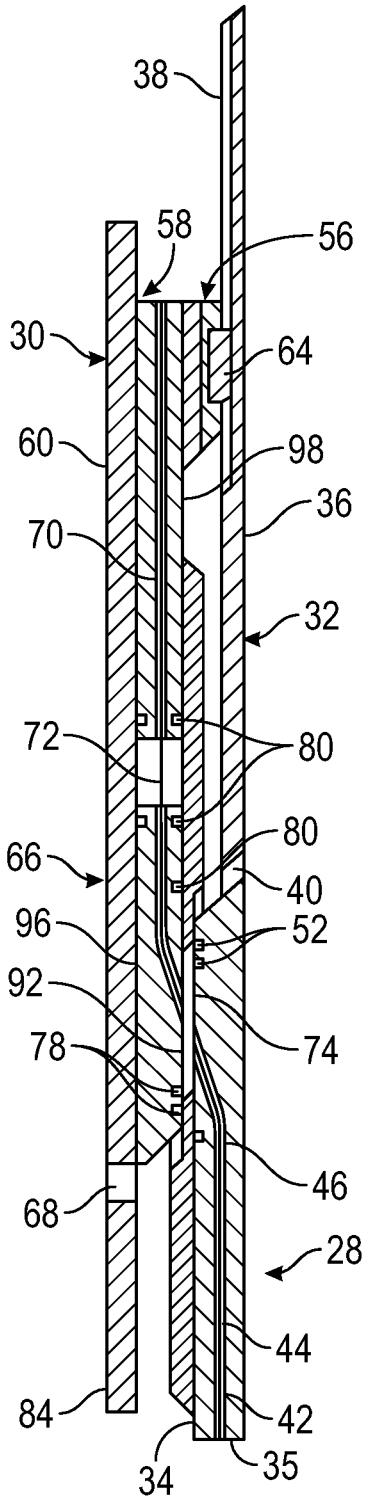
FIG. 8 is a schematic view similar to that of FIG. 1 but showing the first and second completion stages during another period of the engagement process, according to an embodiment of the present invention.

As the insertion of upper completion stage 30 into lower completion stage 28 continues, lower sleeve 48 and upper sleeve 76 continue to retract, as illustrated best in FIG. 7. The continued retraction of the lower and upper sleeve creates a communication line connection chamber 92 that is sealed between upper body portion 62, lower body portion 35, upper sleeve 76 and lower sleeve 48. Continued insertion of upper completion stage 30 into lower completion stage 28 expands the size of chamber 92 until communication line connectors 46 and 74 are exposed to communication line connector chamber 92, as illustrated best in FIG. 8.

Figure 9:
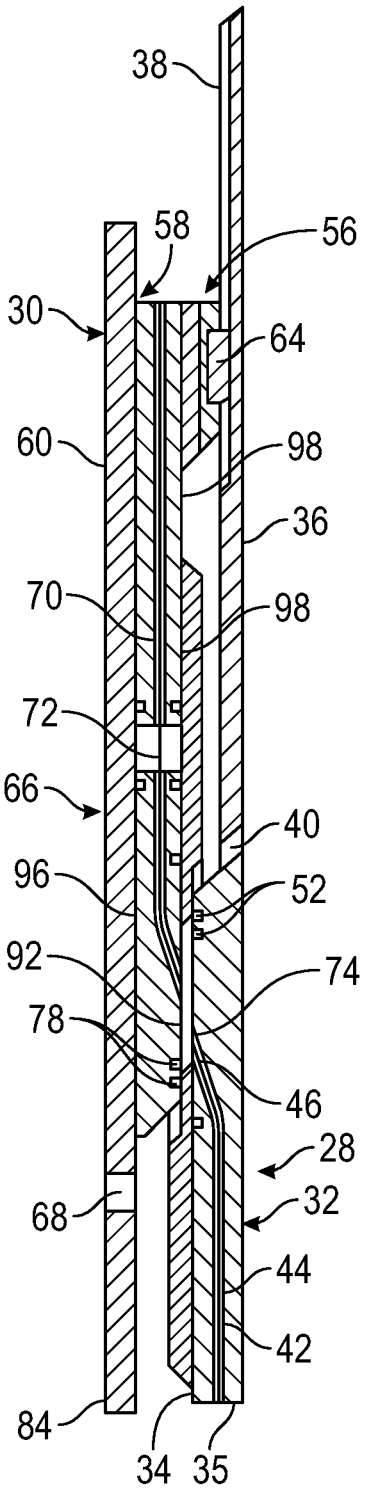
FIG. 9 is a schematic view similar to that of FIG. 1 but showing the first and second completion stages during another period of the engagement process, according to an embodiment of the present invention.
Figure 10:
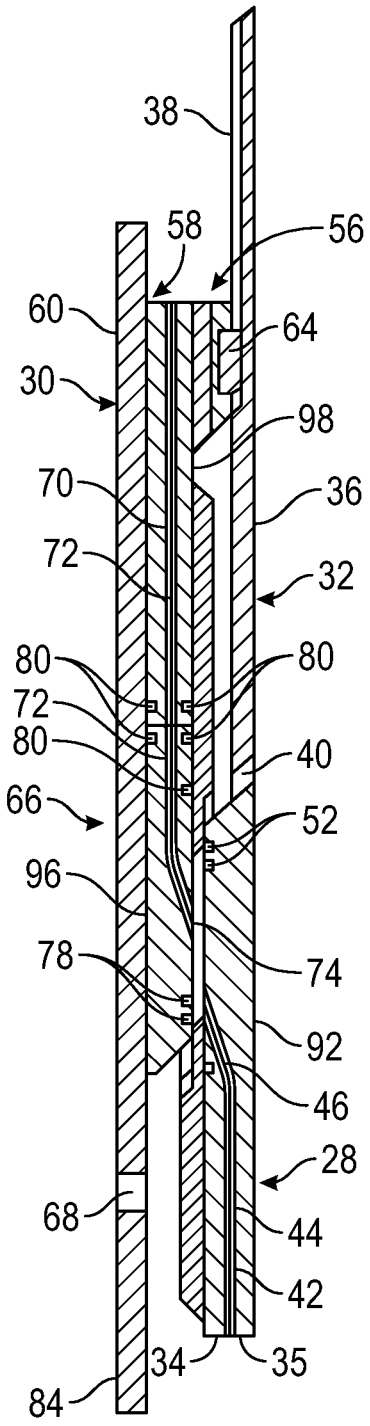
FIG. 10 is a schematic view illustrating full engagement of the first and second completion stages, according to an embodiment of the present invention.

One or both of the communication line connectors can be moved into chamber 92 for coupling with the other connector. In the embodiment illustrated, however, communication line connector 74 is moved into and through chamber 92. In this embodiment, upper body portion 62 is formed as a telescoping body having a first component 96 and a second component 98 that can be moved together to force communication line 72 through passageway 70 of first component 96. The movement of communication line 72 pushes communication line connector 74 into chamber 92, as illustrated best in FIG. 9. Ultimately, the telescoping movement of upper body portion 62 pushes connector 74 into full engagement with connector 46, e.g. into full engagement of a ferrule plug with a ferrule receptacle. The coupling of connectors is accomplished without exposing either of the communication line connectors to detrimental debris or contaminants from the surrounding environment. Also, a telescoping spring (not shown) can be used to hold telescoping body 62 in an open position to ensure that sleeves 48 and 76 are retracted and chamber 92 is fully opened before the telescoping process begins. Relative spring rates between the telescoping spring and the spring biased sleeves can be used to control this mating sequence.

Telescoping body 62 can be designed in a variety of configurations. For example, the telescoping body 62 can be attached to upper completion stage 30 such that allowing the upper completion stage to move further downhole automatically compresses a telescoping spring and cause movement of second component 98 toward first component 96. In another configuration, a piston chamber can be ported to the interior of tubing 60 on one side and to annulus pressure on the other side. A piston within the piston chamber can be used to compress a telescoping spring by increasing tubing pressure above annulus pressure. In another configuration, the piston chamber can be ported to a control line extending to the surface instead of to the interior of tubing 60. In some configurations, pressure within the control line can be increased above annulus pressure to compress the telescoping spring. Alternatively, both sides of the piston chamber can be ported to control lines run to a surface location. Increasing control line pressure in one control line and taking returns with the other control line can be used to again compress the telescoping spring and move second component 98 toward first component 96. These and other configurations can be used to move one or both of the control line connectors into and through chamber 92 in forming a control line coupling.

Figure 11:
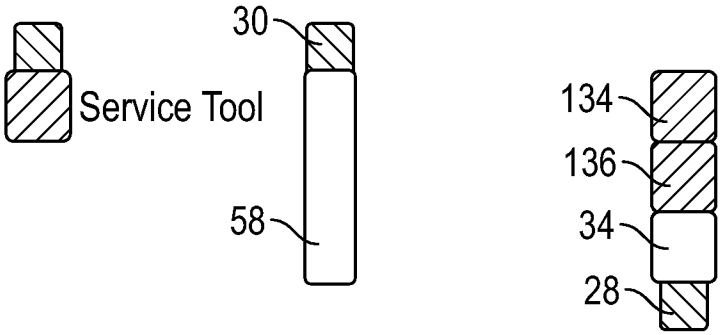
FIG. 11 schematically shows a multi-stage completion including an extended length stinger configured to extend through a packer.

The geometry of lower completion stage 28 and upper completion stage 30 enables efficient and thorough flushing and cleaning of the area around and between the communication line connection components prior to initiating the mating of the two completion stages. Additionally, the communication line connectors and communication lines are fully sealed from wellbore fluids during running of the lower completion stage and the upper completion stage in hole, during the mating sequence, and after the wet-mate connection has been established. The seals used, e.g. seals 52 and 78, can be high-pressure seals that are durable in downhole applications. The sleeve members 48 and 76 and other members forming chamber 92 can be correspondingly sized to withstand high pressures, e.g. the maximum hydrostatic pressure plus injection pressure expected in the wellbore, while the sealed chamber remains at atmospheric pressure In some configurations according to the present disclosure, for example as schematically shown in FIG. 11, a multi-stage completion is sized, shaped, and configured such that when the lower completion 28 is positioned in the wellbore, the lower completion 28 and receptacle 34 are positioned below or downhole of a packer 134. When the upper completion 30 is run downhole to engage the lower completion 28, the stinger 58 extends through the packer 134 to engage or be received in the receptacle 34. In other words, when the upper completion 30 is fully deployed and the stinger 58 is received in the receptacle 34, a portion of the stinger 58 is positioned above or uphole of the packer 134, and a portion of the stinger 58 is positioned below of downhole of the packer 134.

Figure 12A:
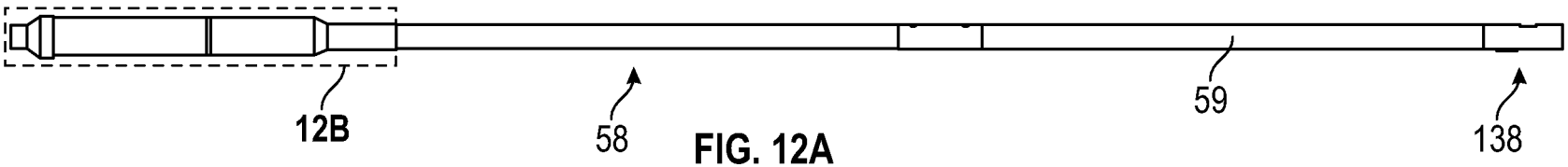
FIG. 12A shows an example stinger for use in a multi-stage completion according to FIG. 11.
Figure 13A:
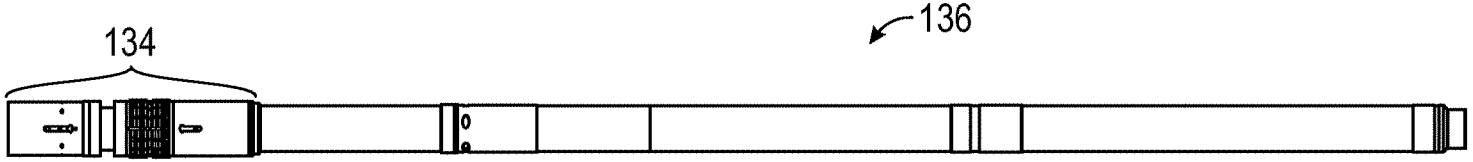
FIG. 13A shows an example packer and extension for use in a multi-stage completion according to FIG. 11.

FIG. 12A shows an example stinger 58 having an extended length and configuration that allows the stinger 58 to pass through a packer 134 and extension 136 (e.g., a gravel pack extension) (for example, as shown in FIG. 13A) in use. The stinger 58 and receptacle 34 include features that allow for a two-stage alignment process to align the communication line connector 46 of the lower completion 28 with the communication line connector 74 of the upper completion 30 as the stinger 58 is moved into engagement with or is received in the receptacle 34 during deployment. The two-stage alignment process includes an initial coarse alignment, followed by a fine alignment.

Figure 12B:
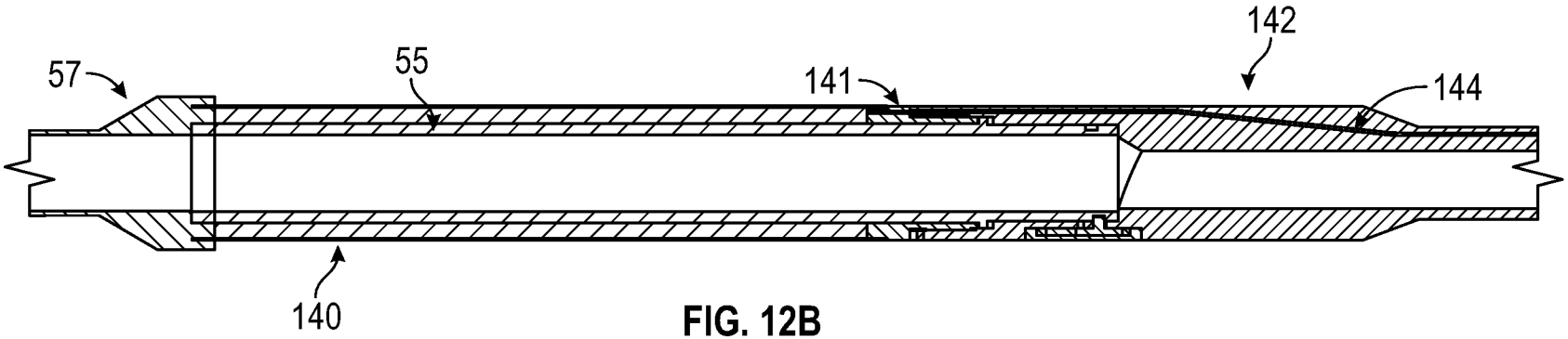
FIG. 12B shows a cross-section of the portion of the stinger labeled 12B in FIG. 12A.

As shown in FIG. 12B, the stinger 58 includes a region 140 at or proximate an upper or uphole end of the stinger 58 designed to house a coiled control line, e.g., a fiber optic or electrical control line, during deployment. In the illustrated configuration, the stinger 58 includes a cap or connector 57 at an upper or uphole end of the stinger 58. In some configurations, the cap or connector 57 contacts or connects to the upper completion 30. An inner tube 55 is connected to and extends downhole from the cap 57. As shown, region 140 is disposed about the inner tube 55. The control line is disposed in an annular space between the inner tube 55 and the region 140. The stinger 58 also includes a swivel sub 142 adjacent or proximate and below or downhole of region 140. In the illustrated configuration, a lower or downhole portion or end of the inner tube 55 extends into an upper or uphole portion or end of the swivel sub 142. A connector or connection region 141, or at least a portion thereof, can be disposed radially about the inner tube 55 and axially between the region 140 and the swivel sub 142. The connector 141 can help couple one or more of the inner tube 55, region 140, and swivel sub 142. The swivel sub 142 includes a channel 144 therethrough for the control line. The control line extends from region 140, through the channel 144, and continues through a channel in a shaft 59 of the stinger 58. One or more additional channels can extend through the swivel sub 142 and/or shaft 59 to allow for water injection and/or hydraulic communication. The swivel sub 142 can rotate relative to the tubing string, e.g., relative to the upper completion 30 and/or lower completion 28 in an unlocked configuration as described in greater detail herein.

Figure 12C:
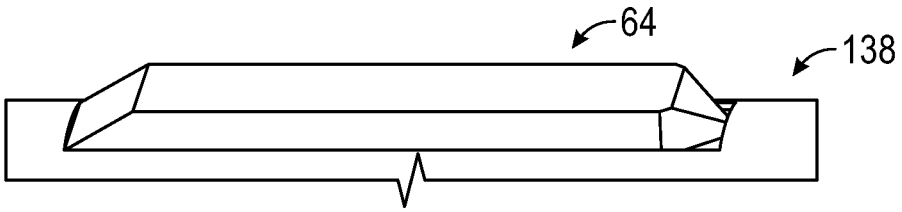
FIG. 12C shows a portion of a nose of the stinger of FIG. 12A including an alignment key.
Figure 12D:
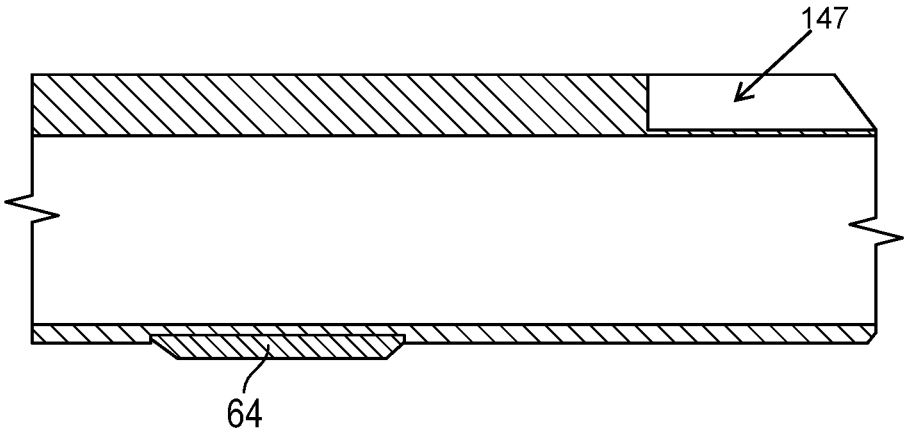
FIG. 12D shows a cross-section of a portion of the nose of the stinger of FIG. 12A.
Figure 12E:
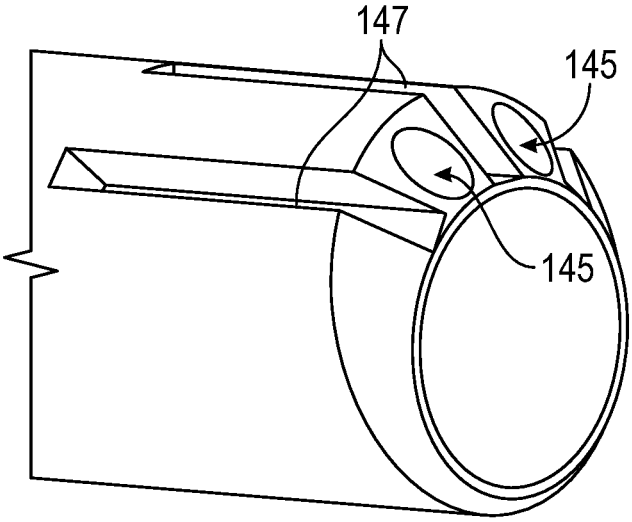
FIG. 12E shows an end portion of the nose of the stinger FIG. 12A.

As shown in FIGS. 12A, 12C, and 12D, a nose 138 of the stinger 58 includes a coarse alignment key 64. A generally opposite (radially opposite or diametrically opposed) side of the nose 138 includes one or more grooves or slots 147 and one or more ports 145 formed at or in a bottom or downhole end of the nose 138 and stinger 58, for example as shown in FIG. 12E. One of the ports 145 is in fluid communication with the channel 144 that contains the control line and extends through the swivel sub 142 and the associated channel through the shaft 59. Each of the other ports 145 is in fluid communication with one of the one or more additional channels extending through the swivel sub 142 and/or shaft 59, for example, for water injection and/or hydraulic communication. The illustrated configuration includes two ports 145 and three slots 147, with the slots 147 and ports 145 alternating.

Figure 13B:
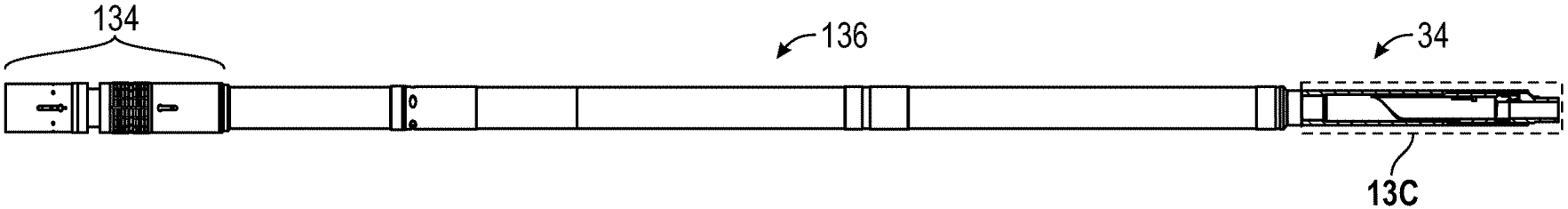
FIG. 13B shows the packer and extension of FIG. 13A coupled to a receptacle.
Figure 13C:
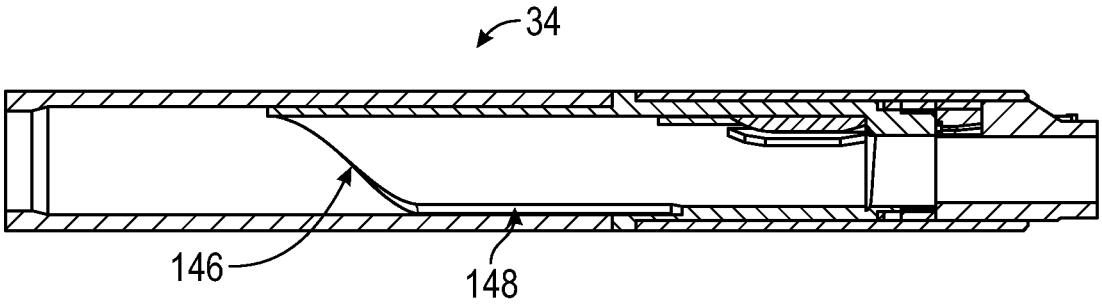
FIG. 13C shows a cross-section of the receptacle of FIG. 13B.
Figure 13D:
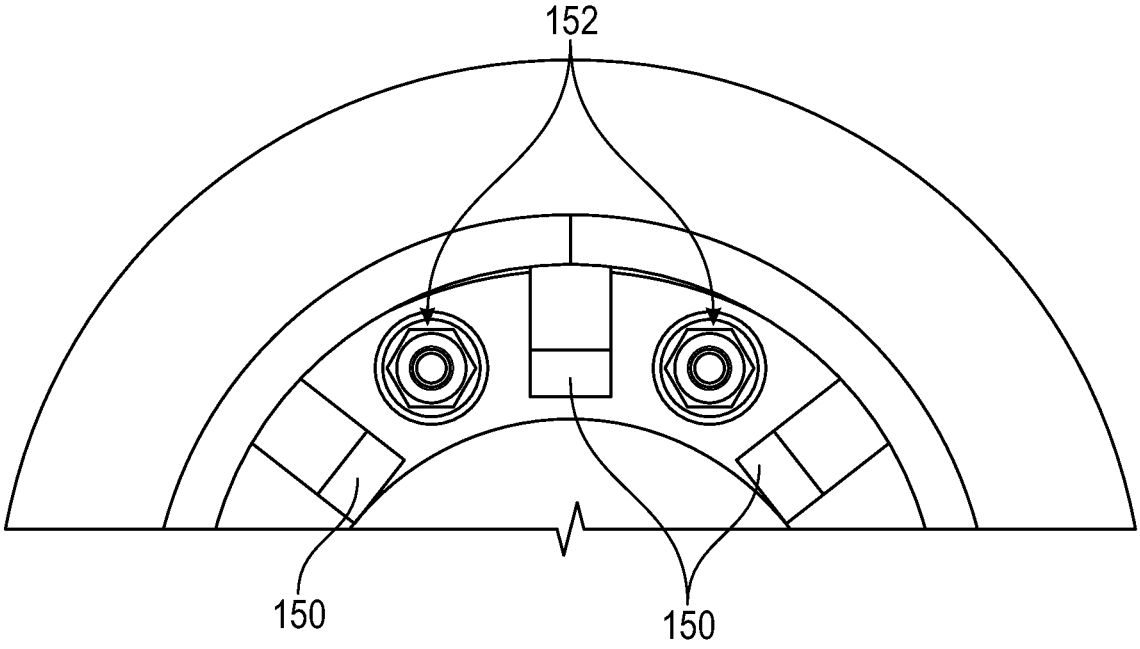
FIG. 13D shows a partial transverse cross-section of the receptacle of FIG. 13B.

As shown in FIG. 13B, once deployed, a bottom or downhole end of the extension 136 couples to the receptacle 34. As shown in FIG. 13C, an interior of the receptacle 34 includes a helical profile 146 and a slot 148. Generally opposite (radially opposite or diametrically opposed) the slot 148, the receptacle 34 includes one or more precision alignment keys 150 and one or more connectors 152, as also shown in FIG. 13D. The illustrated configuration includes two connectors 152 and three precision alignment keys 150 with the connectors 152 and keys 150 alternating.

Figure 15A:
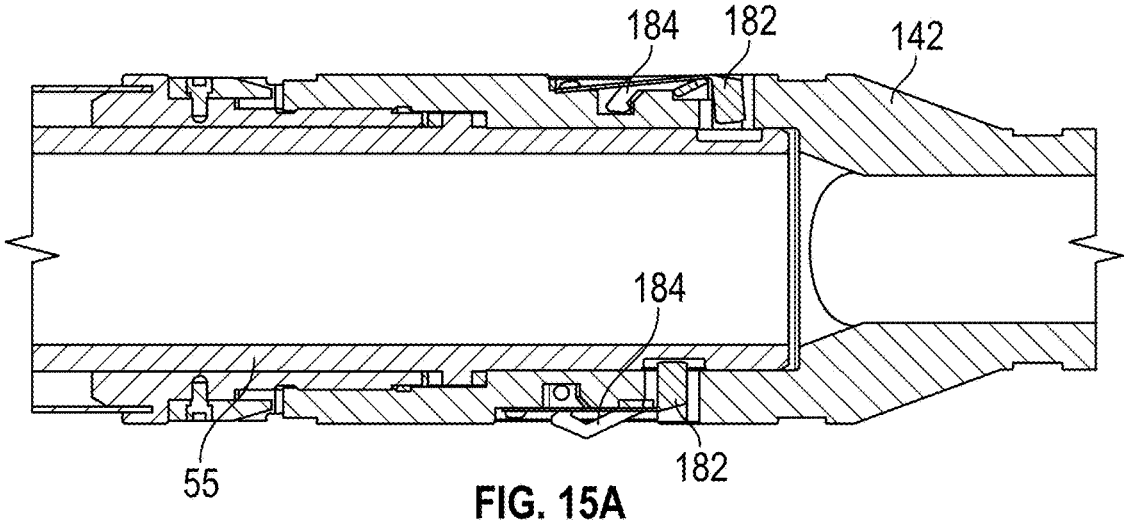
FIG. 15A shows a cross-section of a portion of the stinger of FIG. 12A including a locking mechanism.
Figure 15B:
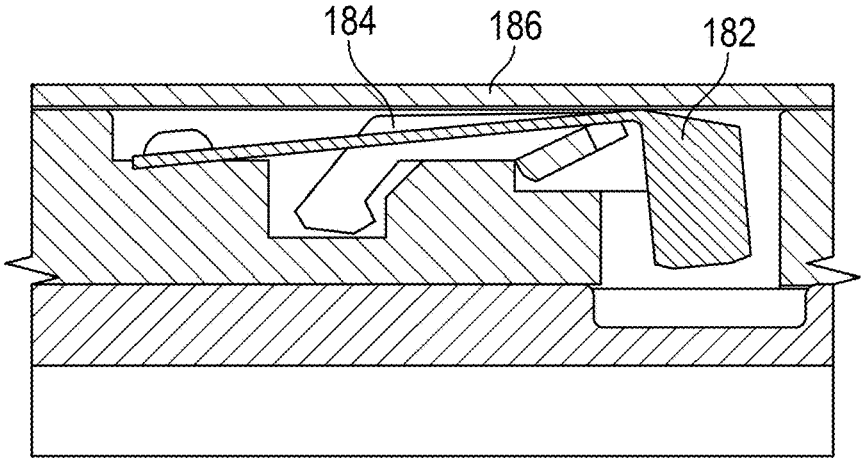
FIG. 15B shows a portion of the locking mechanism of FIG. 15A in an unlocked state.
Figure 15C:
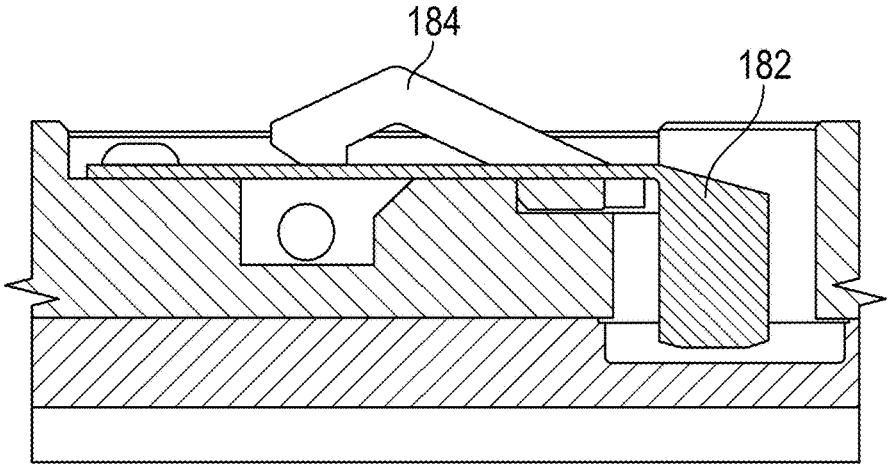
FIG. 15C shows the view of FIG. 15B with the portion of the locking mechanism in a locked state.

In use, as the stinger 58 is moved into the receptacle 34, the coarse alignment key 64 contacts the helical profile 146 and slides along the helical profile 146 as the stinger 58 rotates until the coarse alignment key 64 is aligned with and then slides into and along the slot 148. As the stinger 58 is moved downhole, before reaching the packer and/or receptacle, the stinger 58 is locked against accidental or undesired rotation, for example, via one or more anti-rotation features as shown in FIGS. 15A-15C. When the stinger 58 moves through the packer and reaches the receptacle, a sleeve 186, which may be above or uphole of and/or attached to the packer, allows the stinger to unlock and rotate.

As shown in FIGS. 15A-15C, each anti-rotation feature can include an anti-rotation pin 182 and a lever 184. As shown in FIG. 15C, the anti-rotation pin 182 can be attached to the swivel sub 142 and engage, contact, or extend into a recess in the inner tube 55 in a locked position to rotationally secure the swivel sub 142 relative to the inner tube 55. In the illustrated configuration, the lever 184 is angled and pivotably disposed in or on the swivel sub 142. The lever 184 has a first portion that underlies a portion of the pin 182 (in other words, a portion of the lever 184 is radially between a portion of the pin 182 and a portion of the swivel sub 142) and a second portion that projects radially outwardly beyond an outer surface of the swivel sub 142 in the locked configuration, shown in FIG. 15C.

To unlock the anti-rotation feature, the sleeve 186 slides over or about the swivel sub 142 (e.g., along or adjacent the radial outer surface of the swivel sub 142). The sleeve 186 contacts the second, radially extending portion of the lever 184, thereby causing the lever 184 to pivot and depressing the second portion of the lever 184 radially inwardly into a recess in the swivel sub 142, as shown in FIG. 15B. The pivoting movement of the lever 184 causes the first portion of the lever 184 to extend radially outward (or lift outward and away from the swivel sub 142), thereby lifting the pin 182 radially outward and away from the inner tube 55. In this unlocked position, shown in FIG. 15B, the swivel sub 142 is rotationally decoupled or unlocked from the inner tube 55. In some configurations, the sleeve 186 is coupled to the packer such that as the stinger 58 approaches and/or moves through the packer, the sleeve 186 automatically slides over the swivel sub 142. In other words, the sleeve 186 may be stationary and move relative to, and over, the swivel sub 142 as the stinger 58 comes into the proximity of, or moves through, the packer.

In the configuration illustrated in FIGS. 15A-15C, the stinger 58 includes two anti-rotation features positioned 180° from each other about the circumference of the swivel sub 142. In the illustrated configuration, the two anti-rotation features are axially offset from each other. Positioning the two anti-rotation features at an 180° spacing and/or axially spaced from each other advantageously ensures at least one anti-rotation feature is engaged (in the locked position) while the stinger 58 is run in hole; in other words, if one anti-rotation feature is accidentally unlocked, for example, via slight unintentional shifting or the sleeve 186 or various malfunctions, the other anti-rotation feature can remain independently locked.

Once unlocked, the stinger nose 138, shaft 59, and swivel sub 142 rotate relative to region 140, cap or connector 57, and/or inner tube 55, which are held rotationally fixed or stationary by and/or relative to the upper completion string 30. In some configurations, region 140 can rotate with the swivel sub 142, depending, for example, on friction of the system. Rotation of the swivel sub 142, and in some configurations, region 140 and/or connector or connection region 141, relative to the tubing string, for example, upper completion string 30, cap 57, inner tube 55, and/or region 140 containing the coiled control line, helps prevent or inhibit the control line from becoming twisted and damaged. Region 140 can also act as a shroud to protect the control line(s) from damage by equipment through which the string or stinger 58 is run.

Figure 16:
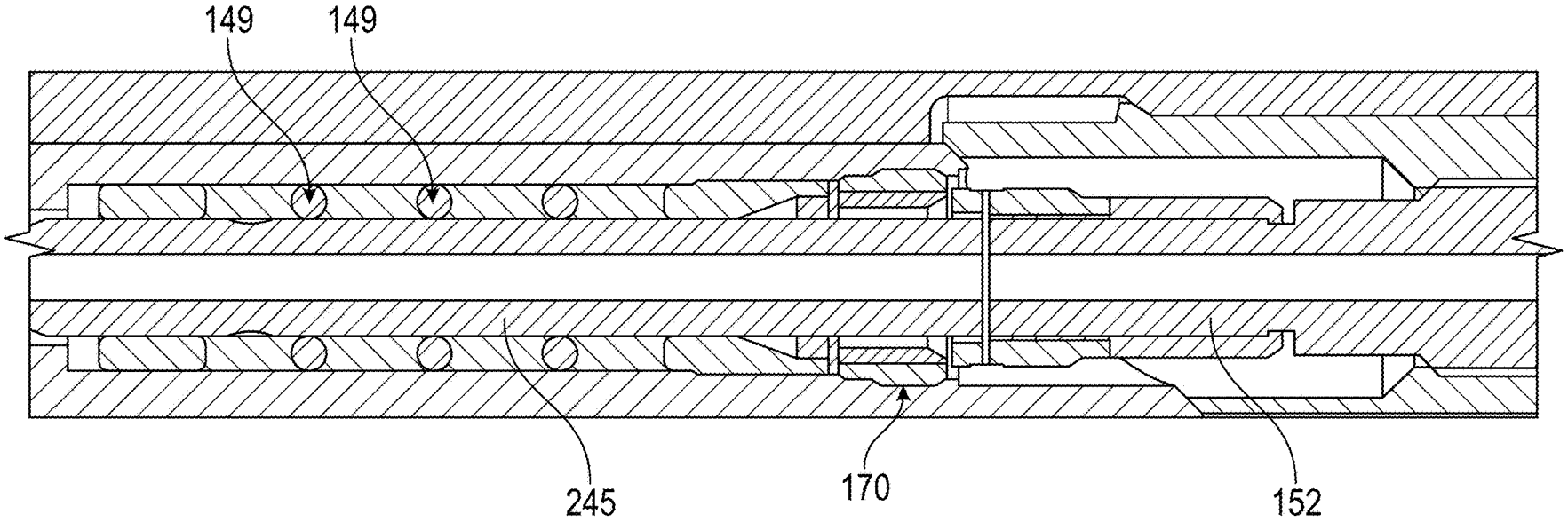
FIG. 16 shows a cross-sectional view of a threaded retainer ring for a seal stack.

Alignment of the key 64 with the slot 148 allows or causes alignment of the slots 147 with the keys 150 and the ports 145 with the connectors 152. As the key 64 slides into the slot 148, the keys 150 slide into the slots 147 and the connectors 152 engage the ports 145 or connectors 245 in or on the ports 145, thereby establishing a continuous control line or fluid pathway from the upper completion 30, through the stinger 58, through the receptacle 34, and to the lower completion 28. In some configurations, the ports 145 include seal stacks 149 to seal between the connector 245 and the surrounding port 145. As shown in FIG. 16, a threaded retainer ring 170 can help hold the seal stack 149 in place, for example, during multiple stab ins. The threaded retainer ring 170 can secure the seal stack 149 better than, for example, a Smalley retainer ring.

In the illustrated configuration, during deployment, rotation of the stinger (e.g., the swivel sub 142 and/or shaft 59) occurs at least partially above or uphole of the packer 134, while alignment and/or control line connection (e.g., connection of the control line of the upper completion 30 with the control line of the lower completion 28, for example, via connection of the port(s) 145 and associated control line(s) or fluid path(s) with the connectors 152) occurs below or downhole of the packer 134 and/or the extension 136.

Figure 14:
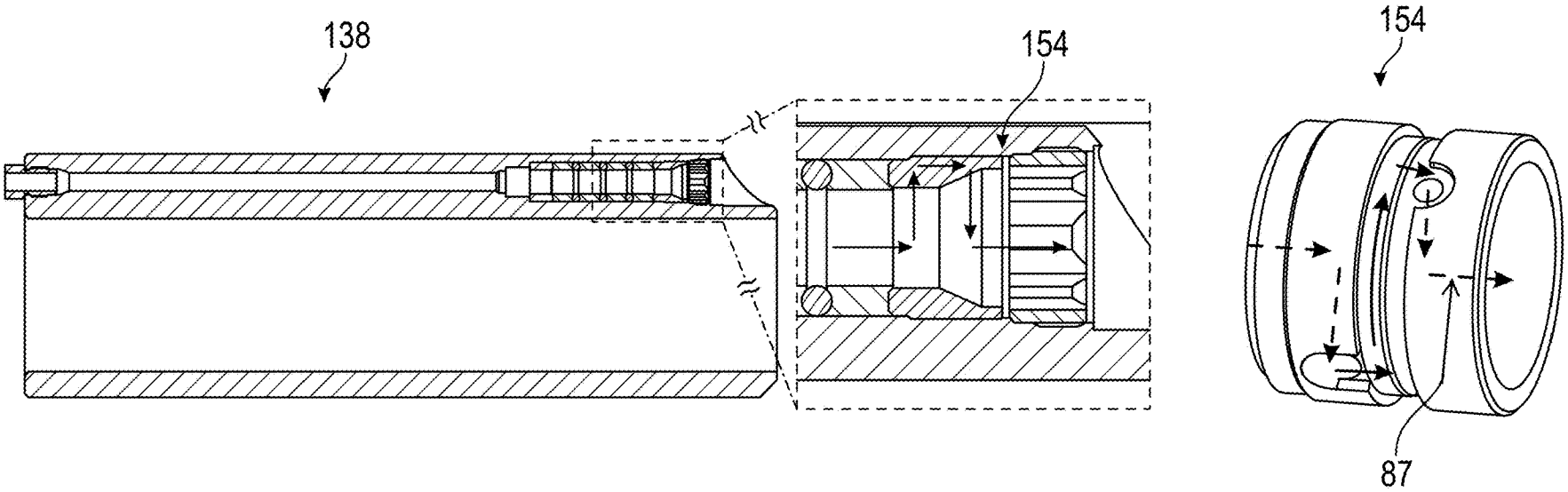
FIG. 14 shows a debris exclusion cover including a flushing fluid flow path.

In some configurations, the stinger 58 and/or the receptacle 34 includes one or more features to exclude or remove debris that may accumulate on or around the upper and/or lower connectors and inhibit a proper connection and/or that may accumulate around seals 149 and degrade pressure integrity of the seal stack. For example, the stinger 58 and/or the receptacle 34 can include a debris exclusion cover 154, as shown in FIG. 14, which may include a cover, such as a rupture disc. As the stinger 58 is run in hole past the gravel pack, the control line channel(s) can be flushed with fluid, e.g., clean water pumped from the surface through the control line of the upper completion, to clear debris. The debris exclusion cover 154 can include a flow path, indicated by arrows 87 in FIG. 14, to allow the fluid to flow around the debris exclusion cover, e.g., around the rupture disc.

In some configurations, corresponding connectors of the lower completion 28 and upper completion 30, for example, connectors 152 and connectors in or on port(s) 145, are electrical connectors to form an electrical connection between the upper completion 30 and lower completion 28. The electrical connectors can be or include, for example, electrical prong connectors that connect to each other, for example, wet-mate electrical connectors available from Diamould. In some configurations, the electrical connectors can be or include inductive coupler components (i.e., a male inductive coupler and a female inductive coupler) to form an electrical connection via an inductive coupler.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A downhole completion system, comprising:

a lower completion stage comprising a receptacle, wherein the receptacle comprises:

a first alignment feature and a second alignment feature, wherein the second alignment feature comprises a first alignment key and a second alignment key; and a first communication line connector disposed between the first alignment key and the second alignment key;

an upper completion stage comprising a stinger, wherein the stinger comprises:

a third alignment feature and a fourth alignment feature, wherein the fourth alignment feature comprises a first slot configured to receive the first alignment key and a second slot configured to receive the second alignment key; and a second communication line connector is disposed between the first slot and the second slot, wherein:

the first alignment feature engages with the third alignment feature and the second alignment feature engages with the fourth alignment feature to align the first communication line connector with the second communication line connector upon insertion of a portion of the stinger through a packer and into the receptacle to couple the first and second communication line connectors.

2. The downhole completion system of claim 1, further comprising fiber optic lines coupled to the first communication line connector and to the second communication line connector.

3. The downhole completion system of claim 1, further comprising tubing lines coupled to the first communication line connector and to the second communication line connector.

4. The downhole completion system of claim 3, wherein the tubing lines are sized to receive a fiber optic line therethrough.

5. The downhole completion system of claim 1, wherein the first and second communication line connectors comprise electrical connectors, and the coupling of the first and second communication line connectors comprises an electrical connection below the packer.

6. The downhole completion system of claim 1, wherein the portion of the stinger is selectively rotatable relative to a remainder of the upper completion stage.

7. The downhole completion system of claim 6, wherein the stinger further comprises an anti-rotation feature to selectively permit rotation of the portion of the stinger relative to a remainder of the upper completion stage.

8. The downhole completion system of claim 7, wherein the stinger further comprises a sleeve slidable from a first position to a second position to permit rotation of the portion of the stinger relative to the remainder of the upper completion stage.

9. The downhole completion system of claim 1, wherein:

the first communication line connector comprises a first port and a second port; and the second communication line connector comprises a third port and a fourth port.

10. The downhole completion system of claim 9, wherein:

the second alignment feature further comprises a third alignment key disposed between the first port and the second port; and the fourth alignment feature further comprises a third slot disposed between the third port and the fourth port.

11. A method of forming a completion in a wellbore, the method comprising:

deploying a lower completion stage in a wellbore downhole of a packer, the lower completion stage comprising a receptacle, wherein the receptacle comprises:

a first alignment feature and a second alignment feature, wherein the second alignment feature comprises a first alignment key and a second alignment key; and a first communication line connector disposed between the first alignment key and the second alignment key;

inserting a portion of a stinger of an upper completion stage through the packer and into the receptacle, wherein the stinger comprises:

a third alignment feature and a fourth alignment feature, wherein the fourth alignment feature comprises a first slot and a second slot; and a second communication line connector, wherein the second communication line connector is disposed between the first slot and the second slot;

aligning the first communication line connector with the second communication line connector, wherein aligning the first communication line connector with the second communication line connector comprises engaging the first alignment feature with the third alignment feature and engaging the second alignment feature with the fourth alignment feature; and coupling the first and second communication line connectors after aligning the first communication line connector with the second communication line connector.

12. The method of claim 11, wherein the lower completion stage comprises a lower fiber coupled to the first communication line connector, and the upper completion stage comprises an upper fiber coupled to the second communication line connector.

13. The method of claim 11, wherein the first and second communication line connectors comprise electrical connectors.

14. The method of claim 11, wherein the lower completion stage comprises a lower tubing line coupled to the first communication line connector, and the upper completion stage comprises an upper tubing line coupled to the second communication line connector.

15. The method of claim 14, further comprising pumping a fiber optic line through the upper tubing line, through the coupled first and second communication line connectors, and through the lower tubing line.

16. The method of claim 11, wherein the stinger further comprises an anti-rotation feature to selectively permit rotation of the portion of the stinger relative to a remainder of the upper completion stage.

17. The method of claim 16, further comprising rotating the portion of the stinger relative to the remainder of the upper completion stage at least partially uphole of the packer.

18. The method of claim 11, wherein the stinger further comprises a sleeve slidable from a first position to a second position to permit rotation of the portion of the stinger relative to a remainder of the upper completion stage.

19. The method of claim 18, further comprising sliding the sleeve from the first position to the second position to permit rotation of the portion of the stinger relative to the remainder of the upper completion stage at least partially uphole of the packer before aligning the first communication line connector with the second communication line connector.

* * * * *